United States Patent [19]

Addy et al.

[11] 4,118,832

[45] Oct. 10, 1978

[54] METHOD FOR MINIMIZING THE ACCUMULATION OF STATIC CHARGES ON FIBERS RESULTING FROM FIBERIZATION OF PULP LAP SHEETS

[75] Inventors: Tralance O. Addy, Media; David P. Gutman, Glen Riddle, both of Pa.

[73] Assignee: Scott Paper Company, Philadelphia, Pa.

[21] Appl. No.: 722,478

[22] Filed: Sep. 13, 1976

[51] Int. Cl.[2] ..... D04H 1/00

[52] U.S. Cl. ..... 19/304; 19/308; 425/80.1; 425/445

[58] Field of Search ..... 19/155, 156–156.4, 19/65 R, 66 R; 156/62.2, 62.4, 62.6; 264/90, 91, 101, 119, 121, 115, 116; 425/80, 445; 427/390 B; 241/4, 28, 15, 16; 118/411

[56] References Cited

U.S. PATENT DOCUMENTS

| | | | |
|---|---|---|---|
| 46,104 | 1/1865 | Harwood | 19/66 R |
| 1,785,823 | 12/1930 | Thoma | 19/66 R X |
| 3,268,954 | 8/1966 | Joa | 19/156.3 |
| 3,511,730 | 5/1970 | Carder | 118/411 |
| 3,591,450 | 7/1971 | Murphy et al. | 162/265 |
| 3,606,175 | 9/1971 | Appel et al. | 19/156.3 X |
| 3,894,314 | 7/1975 | Nayfa | 19/66 R |

FOREIGN PATENT DOCUMENTS

| | | | |
|---|---|---|---|
| 2,116 of | 1861 | United Kingdom | 19/66 R |
| 1,002 of | 1862 | United Kingdom | 19/66 R |
| 2,481 of | 1866 | United Kingdom | 19/66 R |

*Primary Examiner*—Dorsey Newton

*Attorney, Agent, or Firm*—Martin L. Faigus; William J. Foley

[57] ABSTRACT

A method for minimizing the accumulation of static charges on fibers resulting from the dry-fiberization of pulp lap sheets includes the steps of: (1) directing a plurality of the pulp lap sheets into a stacked condition; (2) directing the stack of sheets in a downstream direction to a fiberizing device for separating the fibers from the stack; and (3) applying an antistatic chemical to less than all of the sheets in the stack upstream of the fiberizing device.

17 Claims, 1 Drawing Figure

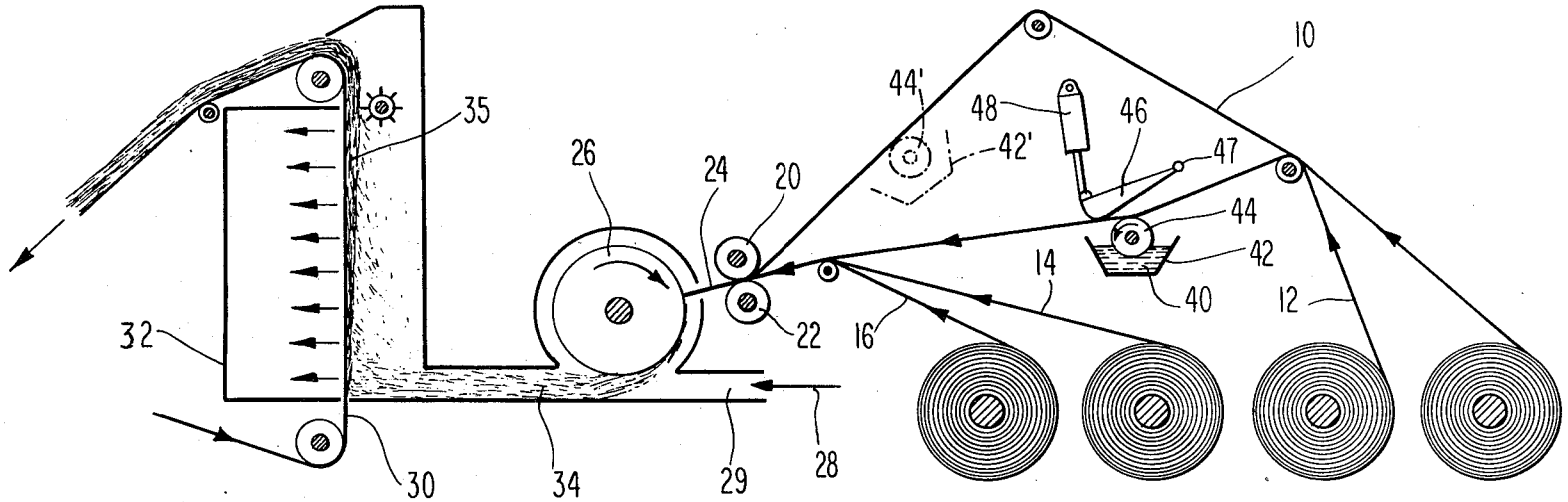
10
12
14
16
20
22
24
26
28
29
30
32
34
35
40
42
42'
44
44'
46
47
48

METHOD FOR MINIMIZING THE ACCUMULATION OF STATIC CHARGES ON FIBERS RESULTING FROM FIBERIZATION OF PULP LAP SHEETS

BACKGROUND OF THE INVENTION

1. Field of the Invention

This invention relates to a method for minimizing the accumulation of static electricity charges on fibers separated from pulp lap sheets in a dry-forming operation.

2. Description of the Prior Art

Dry-formed fibrous webs including wood pulp fibers are well known in the prior art. In forming these webs it is common practice to separate, or comb fibers from dense pulp lap sheets to form a loosely compacted fibrous assemblage. For example, it is common practice to form a loosely compacted batt of 100% wood pulp fibers for use as the absorbent component in sanitary napkins and disposable diapers. Also, in forming air-laid webs including wood pulp fibers blended with longer reinforcing fibers it is common practice to initially form a loosely compacted feed mat of wood pulp fibers from pulp lap sheets prior to the blending operation. A representative method in which wood pulp fibers are blended with longer reinforcing fibers to form a fibrous web is disclosed in U.S. Pat. No. 3,862,472, issued to Norton et al, and assigned to Scott Paper Company.

Apparatus commonly employed for separating fibers from pulp lap sheets and forming a fibrous assemblage therefrom include a fiberizing device, such as a rotating fiberizing roll, for performing the fiber separating function. Such apparatus also include a fiber conveying duct through which the separated fibers are directed and a forming wire upon which the fibers are deposited after they have passed through the conveying duct. The fibers are deposited on the forming wire in the form of a web or mat, and thereafter, the web or mat may be directed to subsequent processing operations, as desired.

The build up of static charges on individual wood pulp fibers commonly results from the combing of said fibers from the dense pulp lap sheets. These static charges cause the fibers to build up on the walls of the fiber conveying duct to obstruct the flow of fibers from the fiberizing roll to the forming wire. This results in high, undesirable basis weight variations in the fibrous assemblage formed on the forming wire. In fact, excessive fiber build up in the conveying duct can actually block the entire flow of fibers to completely "choke" the apparatus. When the fiber build up on the walls of the conveying duct becomes excessive, the apparatus must be shut down to permit it to be cleaned out. Obviously, the necessity of shutting down equipment in a commercial processing operation is highly undesirable.

In order to achieve high production speeds in processes requiring the separation of fibers from pulp lap sheets it is necessary to provide a high mass flow of fibers through the fiber separating equipment. In order to achieve this high mass flow it is common practice to direct multiple pulp lap sheets, in the form of a stack, into engagement with a fiberizing roll of the equipment. It is highly desirable to achieve this high mass flow in a manner which minimizes the accumulation of static charges on the wood pulp fibers.

U.S. Pat. No. 3,268,954, issued to Joa, indicates one prior art approach for attempting to minimize the accumulation of electrostatic charges on individual fibers separated from multiple pulp lap sheets in a dry-fiberizing process. Joa suggests that air which is humidified heavily with water or other liquid can be directed into the processing area in which individual fibers are separated from the multiple sheets of pulp lap. Accordingly, Joa suggests minimizing the accumulation of static charges on the fibers by attempting to treat virtually all of said fibers after they have been separated from the pulp lap sheets. This manner of treating the fibers is not very effective in minimizing the accumulation of static charges. In order to be effective the liquid in the air must be effectively transferred to the fibers. However, the reaction time required to effectively transfer the liquid from the air to the fibers is longer than the dwell time of the fibers in the fiber-separating region of the device. Also, heavy humidification of the air, as taught by Joa, requires the use of undesirably large quantities of liquid.

Other prior art approaches are known for treating virtually all of the fibers of pulp lap sheets to attempt to minimize the accumulation of static charges on said fibers when they are separated, or combed from said sheets. For example, it is known to humidify the ambient air in a storage facility in order to permit moisture to uniformly penetrate rolls of pulp lap sheets. In order to humidify the ambient air in a storage facility expensive humidification systems are required. These systems undesirably increase the capital costs associated with dry-forming processes. Moreover, in some instances the generation of static charges is so severe that humidification of the fibers with water, by itself, will not effectively minimize the accumulation of such charges. In other instances an excessively high degree of humidification is required to minimize the accumulation of static charges on the fibers, and such a high degree of humidification can cause other problems, such as the formation of fiber clumps. These clumps are often directed through the entire process, and wind up in the finished web product to provide an undesirable appearance. In summary, humidification, by itself, represents a high cost approach to minimizing the accumulation of static charges, with, in many cases, limited effectiveness.

It is also known to treat wood pulp fibers with softeners and debonders in the pulping process employed to form pulp lap. For these additives to be effective in minimizing the accumulation of static charges on the individual fibers during a subsequent fiberizing operation it is necessary to include such a large quantity of the additives as to make the process uneconomical.

In several prior art fiberizing processes only a single sheet of fibrous material is separated into its individual fibers. It has been suggested in such processes to apply an antistatic agent to the single fibrous sheet to minimize the accumulation of static charges on the individualized fibers. Representative disclosures of this type of antistatic treatment can be found in U.S. Pat. Nos. 3,591,450 (Murphy et al); 3,881,222 (Roberson); 3,894,314 (Nayfa) and 2,440,399 (Hill). None of the above disclosures are in any way directed to a reliable and efficient process for minimizing the accumulation of static charges on wood pulp fibers resulting from the separation of individual fibers from a stack containing several pulp lap sheets. It is to such a unique process that the present invention is directed.

SUMMARY OF THE INVENTION

The method of this invention resides in directing a plurality of pulp lap sheets into a stacked condition;

directing the stack of sheets in a downstream direction to a fiberizing device for separating fibers from the stack and applying an antistatic chemical to less than all of the sheets in the stack prior to the fiberizing operation. Preferably the number of sheets in the stack is 3 or more; the exact number not constituting a limitation on the broadest aspects of the invention. In accordance with the most preferred method of this invention the antistatic chemical is applied to a surface of only one pulp lap sheet in the stack. This preferred method has been practiced in the fiberizing of a stack containing 10 sheets, and may be usable in a fiberizing operation in which the stack includes more than 10 sheets.

It was quite surprising to applicant to discover that an antistatic chemical did not have to be directly applied to a high percentage of the wood pulp fibers in order to prevent the negative effects of static charge buildup on said fibers from taking place. These negative effects have been discussed earlier in this application, and for purposes of brevity, will not be repeated herein.

As a result of this invention a stack of pulp lap sheets can be treated directly with an antistatic chemical without requiring complex, expensive, liquid application systems. Specifically, applicants have recognized that a separate application device for applying the antistatic chemical to each sheet in the stack is not required. In fact, in the most preferred embodiment of the invention, only a single application device is required to apply the antistatic chemical to a surface of only one sheet in the stack.

Reference in this application to "antistatic chemical", unless more specifically limited, means any liquid or wax-type substance which can be applied to pulp lap sheets to minimize the accumulation of static charges on individual wood pulp fibers separated from the sheets in a subsequent fiberizing operation. Most preferably, the antistatic chemical is a liquid solution or dispersion of a chemical that, for a given volume, is more effective in minimizing the accumulation of static charges on the individual wood pulp fibers than the same volume of liquid, without the chemical. In other words, the antistatic treatment in accordance with the most preferred form of this invention is intended to minimize the volume of liquid addition to the pulp lap sheets while achieving the desired static control.

Preferably the antistatic chemical is in liquid form and is applied to an internal surface of the stack. Most preferably the antistatic chemical is applied to an internal surface other than the internal surface of the bottom sheet or the surface of the adjacent sheet engaging the bottom sheet. When the antistatic chemical is included on the outer exposed surfaces of the stack the treated fibers in those surfaces tend to adhere to feed rolls employed to guide the stack into engagement with the fiberizing device. This can cause a malfunction in the guiding operation. It is well known that excessive quantities of liquid applied to the surfaces of pulp lap sheets tend to cause the fibers to incompletely separate from each other during the fiberizing operation. This results in the generation of clumps which can ultimately wind up in the finished web product. It has also been discovered that the bottom sheet of a multi-sheet stack is the greatest contributor to the formation of clumps during a fiberizing operation. Therefore, it is highly desirable to minimize the percentage of liquid in the bottom sheet, since a high liquid percentage will only aggravate an already bad clumping situation. By applying the antistatic chemical so that it does not come in contact with the bottom sheet in the stack the excessive wetting of said bottom sheet is avoided.

Other objects and advantages of this invention will become apparent upon referring to the detailed description which follows, taken in conjunction with the drawing.

BRIEF DESCRIPTION OF THE DRAWING

The drawing is a schematic side elevation view of an apparatus employed to carry out the process of this invention.

DESCRIPTION OF THE PREFERRED EMBODIMENT OF THE INVENTION

In the preferred embodiment of this invention a plurality of pulp lap sheets 10, 12, 14 and 16 are directed over suitable idler rolls into a stack 24 by the action of opposed feed rolls 20 and 22. These feed rolls are positively driven by any suitable power source (not shown), and include knurled surfaces to aid in gripping the stack 24 to feed it into engagement with the outer periphery of a rotating fiberizing roll 26. As is well known in the art, the fiberizing roll 26 has projections on its periphery for engaging the stack of sheets to separate, or comb individual fibers from it. A flow of air, indicated by arrow 28, is directed into an inlet conduit 29 for entraining the separated fibers in air as said fibers are released from the fiberizing roll 26. A pressure differential is established across a foraminous forming wire 30 through a vacuum box 32. This aids in directing the air entrained fibers through a fiber-conveying duct 34 onto the periphery of the forming wire 30 to form a fibrous mat 35.

The method of this invention resides in applying an antistatic chemical 40 to less than all of the pulp lap sheets which are directed into the stack 24. In the preferred embodiment of the invention the antistatic chemical 40 is retained in a reservoir 42 through which a fluid applicator roll 44 is rotated. A fluid applicator roll 44 which has been employed successfully in this invention is a rubber covered roll in which the rubber covering is ¼ inches thick and has a hardness of 30 Durometers. Employing a roll coater has been found to be highly reliable in applying a uniform coating of the antistatic chemical onto the surface of a pulp lap sheet.

It is possible to apply the antistatic chemical by spraying; however, spraying is not a preferred method of application. First, it is extremely difficult to control the spray to achieve uniform fluid distribution on a surface of a pulp lap sheet. Secondly, spraying the antistatic chemical can cause misting of the fluid into the atmosphere; resulting in an undesirable loss of said fluid. Moreover, many of the antistatic chemicals which are usable in this process are somewhat toxic, and misting of those chemicals presents a health and/or safety hazard to people in the processing area.

Although the antistatic chemical can be applied to surfaces of more than one pulp lap sheet, it is most preferable to apply the antistatic chemical to a single surface of only one pulp lap sheet of the stack 24. As shown in solid line representation in the drawing, the antistatic chemical 40 is applied to the lower surface of internal pulp lap sheet 12, which is biased against the periphery of fluid applicator roll 44 by an upper pressure shoe 46. The shoe 46 is mounted for pivotal movement at 47, and its movement is controlled by an air cylinder 48. In the event that the process line has to be stopped the air cylinder 48 can be retracted to pivot the shoe 46 to a position which permits sheet 12 to release from the periphery of roll 44. In this manner excessive localized chemical addition to the sheet 12 is avoided. Although only four rolls of pulp lap sheet are shown in the drawing, applicants have found that coating only one surface of a single sheet of pulp lap in a stack of 10 sheets is effective in minimizing the accumulation of static charges on individual fibers which are separated from said stack in a subsequent fiberizing operation. Applicants were quite surprised that it was not necessary to coat each of the pulp lap sheets directed into the stack 24 in order to achieve the desired static control.

In the preferred method of this invention the antistatic chemical is applied directly to an interior surface of a single pulp lap sheet of the stack 24; but preferably not to either the interior surface of the bottom sheet 16 or the surface of the pulp lap sheet 14 which engages said bottom sheet. The reason for controlling the addition of the antistatic chemical in this manner has been discussed earlier, and for purposes of brevity will not be repeated herein.

If desired, additional roll coaters can be used to apply the antistatic chemical to more than one pulp lap sheet in the stack. A portion of such a coater, for applying the antistatic chemical to the interior surface of the pulp lap sheet 10, is schematically indicated by the phantom representation of reservoir 42' and applicator roll 44'. Even though it is within the scope of this invention to apply the antistatic chemical to more than one pulp lap sheet, there does not appear to be any valid reason for doing so. As explained above, if more than one sheet were to be coated, additional roll coating equipment would be required. This would increase the overall equipment costs associated with the process. Moreover, additional plant space would be necessary in order to accomodate the roll coaters, and more complicated feed systems would be required to direct additional pulp lap sheets through the additional roll coaters. In addition, unnecessarily high quantities of the antistatic chemical would be employed in the process.

This invention is believed to be highly significant because it provides an extremely simple and reliable manner for virtually eliminating the adverse effects associated with the build up of static charges on individual fibers in a fiberizing operation, while permitting multiple sheets of pulp lap to be directed through said fiberizing operation. This permits the high mass throughput of wood pulp fibers necessary for high speed dry-forming operations. Specifically, applicant has discovered that, in accordance with the most preferred embodiment of this invention, a large number of pulp lap sheets can be directed into and through a fiberizer while applying an antistatic chemical to a surface of only one sheet in the stack.

The amount of antistatic chemical which must be added to the pulp lap sheets to minimize the accumulation of static charges on the individual wood pulp fibers can be determined empirically. Specifically, the amount of chemical is adjusted so as to prevent the fibers from building up on the walls of the fiber conveying duct 34. That amount will vary depending on many different factors, such as, for example, the type of pulp utilized, environmental conditions in the processing area, the number of pulp laps being fiberized, the speed at which the pulp laps are directed to the fiberizing device, the type of fiberizing equipment used and the type and concentration of the antistatic chemical employed.

Most preferrable the antistatic chemicals employed in this invention are organic. Inorganic salts, such as sodium chloride and ammonium chloride, will prevent excessive accumulation of static charges on wood pulp fibers; however, such salts have been found to be corrosive to machine parts.

Most of the antistatic chemicals employed by applicants are commercially available surfactants; preferably of the cationic type. One of the more preferred compounds for use in this invention is a methosulfate quaternary compound which is 90% active, and is sold under the trademark VARISOFT 222 by Ashland Chemical Company of Columbus, Ohio. Another highly desirable compound is VARSTAT 66, which is a 100% active ethosulfate quaternary compound also manufactured by Ashland Chemical Company. Preferably, VARISOFT 222 and VARSTAT 66 are applied in a concentration of under 7%, and most preferably in a concentration range of from about 3.0% to about 4.5%.

The upper concentration limit of the antistatic chemical should be no higher than is necessary to achieve the desired static control, i.e., the prevention of fiber build up on the walls of the fiber conveying duct 34. The lower concentration limit is dictated by the amount of liquid which can be added to the pulp lap sheets without causing excessive clump generation. To further explain, if the concentration of the antistatic chemical is too low, the quantity of liquid which would have to be added to eliminate the adverse static effects would be so high as to cause excessive clump formation in the fiberizing operation.

Having described our invention we claim:

1. A method for minimizing excessive accumulation of static charges on fibers resulting from separating the fibers from pulp lap sheets in a dry-forming operation, said method comprising the steps of:

a. directing a plurality of pulp lap sheets into a stacked condition;
b. directing the stack of sheets in a downstream direction to a fiberizing device for separating fibers from the stack; and
c. applying an antistatic chemical directly to a single surface of only one pulp lap sheet by directing a moving surface, with the chemical thereon, into engagement with said single surface as said sheet is being directed toward the fiberizing device, said single surface being disposed in the interior of the stack.

2. The method according to claim 1, including applying the antistatic chemical to an interior surface of the stack other than either of the contacting inner surfaces of the bottom sheet and its adjacent sheet.

3. A method for minimizing excessive accumulation of static charges on fibers resulting from separating the fibers from pulp lap sheets in a dry-forming operation, said method comprising the steps of:

a. separating fibers from pulp lap sheets by directing a plurality of pulp lap sheets in a stacked condition in a downstream direction into engagement with a fiberizing device;
b. entraining the separated fibers in air;
c. conveying the air-entrained fibers through a fiber-conveying duct toward a foraminous forming surface to form a fibrous assemblage on said surface; the improvement of:
d. applying an antistatic chemical directly to a single surface of only one pulp lap sheet upstream of the fiberizing device in an amount which is effective to substantially prevent fibers from building up on walls of the fiber-conveying duct, said anti-static chemical being applied to said one pulp lap sheet by directing a moving surface, with the chemical thereon, into engagement with said single surface as said one pulp lap sheet is being directed toward the fiberizing device, said single surface being disposed in the interior of the stack.

4. The method according to claim 3, including applying the antistatic chemical to an interior surface of the stack other than either of the contacting inner surfaces of the bottom sheet and its adjacent sheet.

5. A method for minimizing excessive accumulation of static charges on fibers resulting from separating the fibers from pulp lap sheets in a dry-forming operation, said method comprising the steps of:

a. separating fibers from pulp lap sheets by directing a plurality of pulp lap sheets in a stacked condition in a downstream direction into engagement with a fiberizing device;

b. entraining the separated fibers in air;

c. conveying the air-entrained fibers through a fiber-conveying duct toward a foraminous forming surface to form a fibrous assemblage on said surface; the improvement of:

d. applying an antistatic chemical to at least one and less than all of the sheets in the stack upstream of the fiberizing device in an amount which is effective to substantially prevent fibers from building up on walls of the fiber-conveying duct, including applying the chemical to a first pulp lap sheet surface prior to directing that surface into engagement with a second, contiguous surface of another pulp lap sheet of the stack, whereby the first pulp lap sheet surface is positioned in the interior of the stack.

6. The method according to claim 5 wherein the antistatic chemical is applied to the first pulp lap sheet surface by engaging this first surface with a moving surface containing the antistatic chemical.

7. The method according to claim 5 including applying the antistatic chemical only to sheet surfaces that are included in the interior of the stack.

8. The method according to claim 7 including applying the antistatic chemical to surfaces included in the interior of the stack other than either of the contacting inner surfaces of the bottom sheet of the stack and its adjacent sheet.

9. The method according to claim 5 wherein the antistatic chemical is a liquid solution or dispersion of a chemical that, for a given volume, is more effective in minimizing the accumulation of static charges on the individual wood pulp fibers than the same volume of liquid, without the chemical.

10. The method according to claim 9 including applying the antistatic chemical only to sheet surfaces that are included in the interior of the stack.

11. The method according to claim 10 including applying the antistatic chemical to surfaces included in the interior of the stack other than either of the contacting inner surfaces of the bottom sheet of the stack and its adjacent sheet.

12. The method according to claim 9 wherein the antistatic chemical is applied to the first pulp lap sheet surface by engaging this first surface with a moving surface containing the antistatic chemical.

13. The method according to claim 5 including applying said effective amount of the antistatic chemical to less than 50% of the sheets in the stack.

14. The method according to claim 13 wherein the antistatic chemical is a liquid solution or dispersion of a chemical that, for a given volume, is more effective in minimizing the accumulation of static charges on the individual wood pulp fibers than the same volume of liquid, without the chemical.

15. The method according to claim 13 including applying the antistatic chemical only to sheet surfaces that are included in the interior of the stack.

16. The method according to claim 15 including applying the antistatic chemical to interior surfaces other than either of the contacting inner surfaces of the bottom sheet of the stack and its adjacent sheet.

17. The method according to claim 16, wherein the antistatic chemical is a liquid solution or dispersion of a chemical that, for a given volume, is more effective in minimizing the accumulation of static charges on the individual wood pulp fibers than the same volume of liquid, without the chemical.

* * * * *